US006843227B2

(12) United States Patent
Han

(10) Patent No.: US 6,843,227 B2
(45) Date of Patent: Jan. 18, 2005

(54) ELECTRONIC THROTTLE CONTROL SYSTEM FOR A VEHICLE

(75) Inventor: Dong-Uk Han, Seongnam (KR)

(73) Assignee: Hyundai Motor Company, Seoul (KR)

( * ) Notice: Subject to any disclaimer, the term of this patent is extended or adjusted under 35 U.S.C. 154(b) by 4 days.

(21) Appl. No.: 10/318,603

(22) Filed: Dec. 12, 2002

(65) Prior Publication Data

US 2003/0111046 A1 Jun. 19, 2003

(30) Foreign Application Priority Data

Dec. 18, 2001 (KR) ..... 2001-0080876

(51) Int. Cl.[7] ..... F02D 9/08
(52) U.S. Cl. ..... 123/396; 123/399; 123/337
(58) Field of Search ..... 123/399, 337, 123/396, 305, 361; 251/305

(56) References Cited

U.S. PATENT DOCUMENTS 4,947,815 A * 8/1990 Peter ..... 123/399
5,787,861 A * 8/1998 Suzuki et al. ..... 123/396
5,975,051 A * 11/1999 Yamada et al. ..... 123/396
6,079,390 A * 6/2000 Hashimoto et al. ..... 123/399
6,089,208 A * 7/2000 Kowatari et al. ..... 123/396
6,152,108 A * 11/2000 Adachi et al. ..... 123/399
6,199,535 B1 * 3/2001 Hara ..... 123/396
6,276,664 B1 * 8/2001 Keller ..... 251/129.12
6,289,874 B1 * 9/2001 Keefover ..... 123/399
6,345,604 B1 * 2/2002 Ahrns et al. ..... 123/398
6,523,522 B1 * 2/2003 Costin ..... 123/399
6,649,111 B2 * 11/2003 Hannewald et al. ..... 264/278
6,672,280 B2 * 1/2004 Price et al. ..... 123/337
6,694,947 B2 * 2/2004 Wayama et al. ..... 123/399

FOREIGN PATENT DOCUMENTS

JP 10331664 12/1998

* cited by examiner

*Primary Examiner*—Hai Huynh
(74) *Attorney, Agent, or Firm*—Morgan Lewis & Bockius LLP

(57) ABSTRACT

An electronic throttle control system is provided, which comprises an accelerator pedal position sensor, a control unit, and a biasing mechanism. The accelerator pedal position sensor detects a position of an accelerator pedal. The throttle actuator actuates a throttle valve to rotate. The control unit determines a target throttle position based on the accelerator pedal position, and controls an operation of the throttle actuator in accordance with the determined target throttle position. The biasing mechanism provides rotational force to the throttle valve such that an opening angle of the throttle valve while the throttle actuator is not powered is greater than a predetermined idle opening angle.

6 Claims, 4 Drawing Sheets

ELECTRONIC THROTTLE CONTROL SYSTEM FOR A VEHICLE

FIELD OF THE INVENTION

The present invention relates to an electronic throttle control system for the engine of a vehicle, and more particularly, to an electronic throttle control system in which the throttle valve is positioned to remain slightly open in case of a failure of the electronic throttle control system, in order to operate an engine at a predetermined speed.

BACKGROUND OF THE INVENTION

Generally, an electronic throttle control system determines a target throttle valve position, based on an accelerator pedal position and other engine operating parameters, and electronically regulates the position of the throttle valve. In a conventional electronic throttle control system the throttle valve is fully closed by a return spring when the throttle actuator is not powered. To draw air into the engine while the throttle valve is fully closed, a bypass line and a bypass valve are provided. The bypass valve closes or opens the bypass line. If the bypass valve is opened, air is induced into the engine even while the throttle valve is fully closed. Thus, the engine may operate at a predetermined speed.

The conventional electronic throttle control system must include the bypass line and the bypass valve so that the engine can function in case of a throttle control system failure. The addition of the bypass valve and bypass line complicates the system. In addition, control of the bypass valve is needed, so the conventional electronic throttle control system becomes even more complicated. Furthermore, as the return spring wears, precise control of the position of the throttle valve becomes difficult.

The information disclosed in this Background of the Invention section is only for enhancing the understanding of the background of the invention and should not be taken as an acknowledgement or any form of suggestion that this information forms the prior art that is already known to a person skilled in the art.

SUMMARY OF THE INVENTION

An electronic throttle control system, in a preferred embodiment of the invention includes: an engine control unit, with the engine control unit determining a target throttle position based on engine operating parameters; an accelerator pedal position sensor, with the pedal position sensor sending a signal indicative of an accelerator pedal position to the engine control unit; a throttle control unit, with the throttle control unit operating a throttle actuator according to a target throttle position signal from the engine control unit; a throttle valve positioned by the throttle actuator to the target throttle position; a first return spring acting on the throttle valve in a closing direction; and a second return spring acting on the throttle valve in an opening direction, with the first return spring and the second return spring being positioned and configured to position the throttle valve at an emergency position if the throttle control system fails.

Preferably, the second return spring is a coil spring, with one end being connected to a spring seat while the other end is connected to a throttle body. The first return spring and the second return spring are connected to opposite sides of the spring seat. Preferably, the first spring is also a coil spring and the spring seat is a circular plate.

In another preferred embodiment of the invention the electronic throttle control system includes: an accelerator pedal position sensor for detecting a position of an accelerator pedal; a throttle actuator for actuating a throttle valve to rotate; a control unit for determining a target throttle position based on the accelerator pedal position, and for controlling the throttle actuator in accordance with the target throttle position; and a biasing mechanism providing rotational force to the throttle valve so that, if the throttle actuator is not powered, an opening angle of the throttle valve is greater than an idle opening angle.

Preferably, the biasing mechanism includes: a connecting shaft fixedly connected to the throttle valve; a spring seat fixedly connected to the connecting shaft; a first return spring connected between the spring seat and a throttle body such that the first return spring urges the throttle valve to rotate in a closing direction; and a second return spring connected between the spring seat and the throttle body such that the second return spring urges the throttle valve to rotate in an opening direction.

A further preferred embodiment of the throttle control system includes: a throttle valve at a throttle position; a throttle valve actuator for positioning the throttle valve according to a target throttle position signal; a control unit for determining a target throttle position and for controlling the throttle valve actuator to position the throttle valve at the target throttle position; an accelerator pedal position sensor for detecting an accelerator pedal position and communicating the accelerator pedal position to the control unit, wherein the control unit determines the target throttle position based on the accelerator pedal position; a throttle position sensor for determining the throttle position and communicating the throttle position to the control unit; and a biasing mechanism, including a shaft, for positioning the throttle valve at an emergency position when the throttle control system fails.

BRIEF DESCRIPTION OF THE DRAWINGS

The accompanying drawings, which are incorporated in and constitute a part of the specification, illustrate an embodiment of the invention, and, together with the description, serve to explain the principles of the invention, where.

Like numerals refer to similar elements throughout the several drawings.

DETAILED DESCRIPTION OF THE PREFERRED EMBODIMENTS

Figure 1:
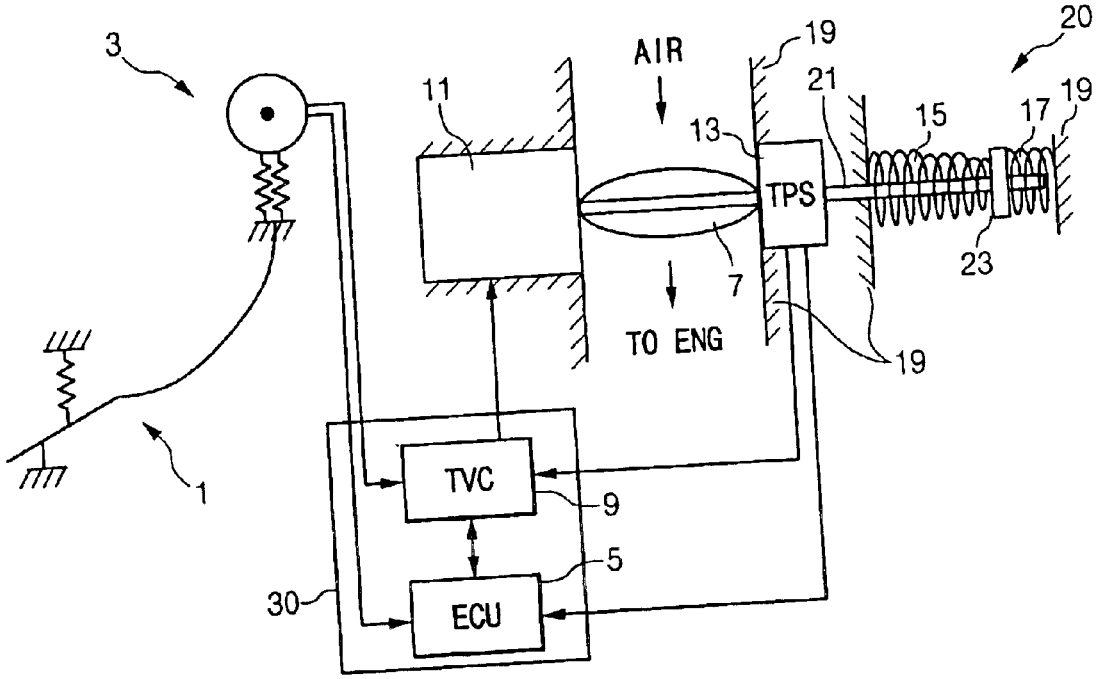
FIG. 1 is a schematic diagram of an electronic throttle control system according to a preferred embodiment of the present invention.

As shown in FIG. 1, the electronic throttle control system according to a preferred embodiment of the present invention eliminates the bypass line, bypass valve, and the corresponding control. In the throttle control system an accelerator position sensor 3 detects a position of an accelerator pedal 1. A control unit 30 determines a target throttle position based on the accelerator position and various engine operation conditions, such as engine speed (RPM), and directs the positioning of a throttle valve 7. The control unit 30, may include an engine control unit (ECU) 5 and a throttle control unit (TCU) 9 in communication with each other. The engine control unit 5 determines a target throttle position based on an output signal (for example, a voltage signal) of the accelerator pedal sensor 3. The output signal of the accelerator pedal sensor 3 is indicative of the accelerator pedal position. The throttle control unit 9 controls a throttle actuator (for example, a motor, or a stepper motor) 11 according to a target throttle position signal input from the engine control unit 5. The throttle valve 7 is moved by the throttle actuator 11 to the target throttle position.

The engine control unit 5 and the throttle control unit 9 preferably include a processor, a memory, and other necessary hardware and software components, as will be understood by persons of ordinary skill in the art, to permit the control unit to communicate with sensors and execute the control function as described herein. The engine control unit 5 receives the throttle position signal from the throttle position sensor 13, and determines the throttle position.

The electronic throttle control system according to a preferred embodiment of the present invention also includes a biasing mechanism 20 for positioning the throttle valve 7 slightly open when the throttle actuator 11 does not operate, due to, for example, system failure or loss of power. The biasing mechanism 20 includes a first return spring 15 that urges the throttle valve 7 to rotate in a closing direction. A second return spring 17 urges the throttle valve 7 to rotate in an opening direction. The biasing mechanism 20 further includes a connecting shaft 21, and a spring seat 23 having a circular plate shape.

The spring seat 23 is fixedly connected to the connecting shaft 21 that is itself fixedly connected to the throttle valve 7. The first return spring 15 is disposed on one side of the spring seat 23, and the second return spring 17 is disposed on an opposite side of the spring seat 23. One end of the first return spring 15 is connected to the spring seat 23, and the other end of the first return spring 15 is connected to the throttle body 19. The first return spring 15 is arranged to bias the spring seat 23 to rotate in a closing direction. Similarly, the second return spring 17 connects the spring seat 23 and the throttle body 19 such that the spring seat 23 is biased to rotate in an opening direction.

Figure 2:
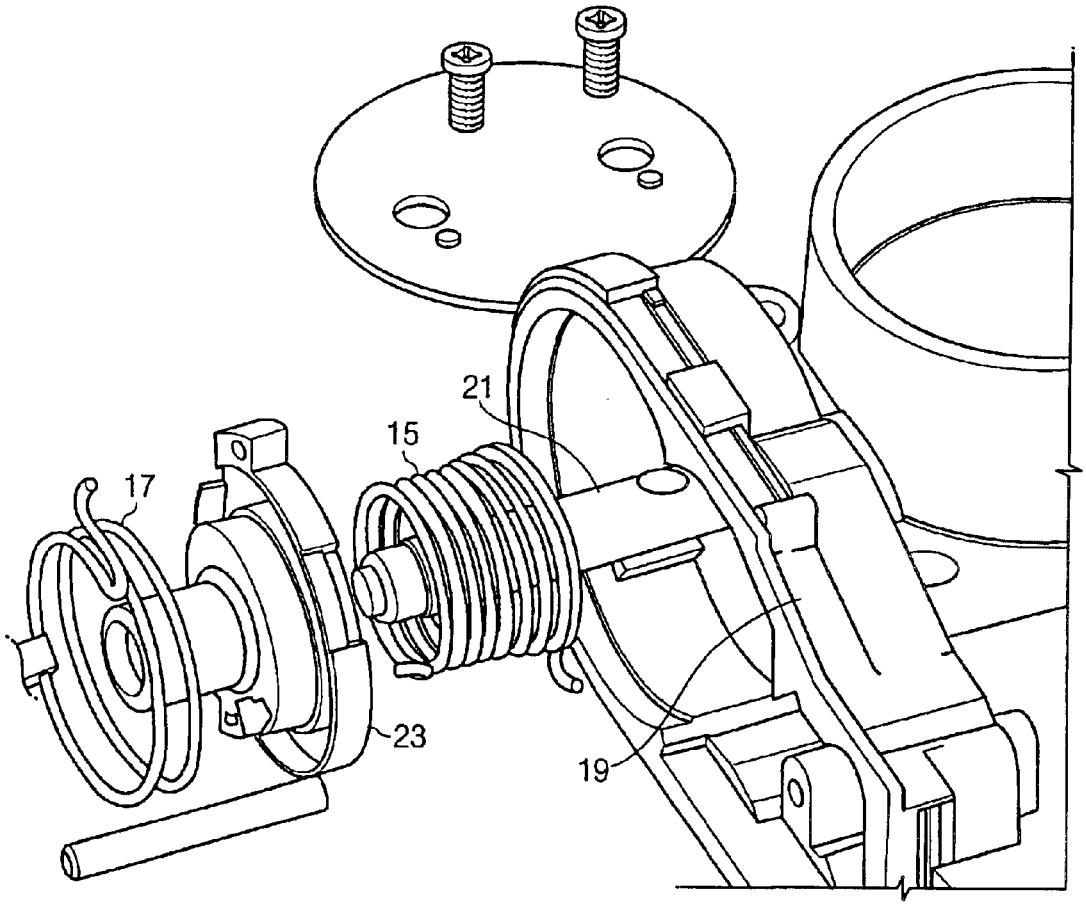
FIG. 2 is an exploded perspective view of a biasing mechanism of the system of FIG. 1.

As shown in FIG. 2, both the first return spring 15 and the second return spring 17 are preferably coil springs. The number of winds of the first return spring 15 is greater than that of the second return spring 17 so that the throttle is positioned slightly open while the throttle actuator 11 is not powered. That is, the first return spring 15 generates a lesser rotating force than the second return spring 17 so that the first and second return springs 15 and 17 position the throttle valve 7 slightly open when the throttle actuator does not operate. This slightly open state of the throttle valve 7 can be referred to as an emergency state of the throttle valve 7, that allows the engine to operate at a predetermined speed.

Figure 3:
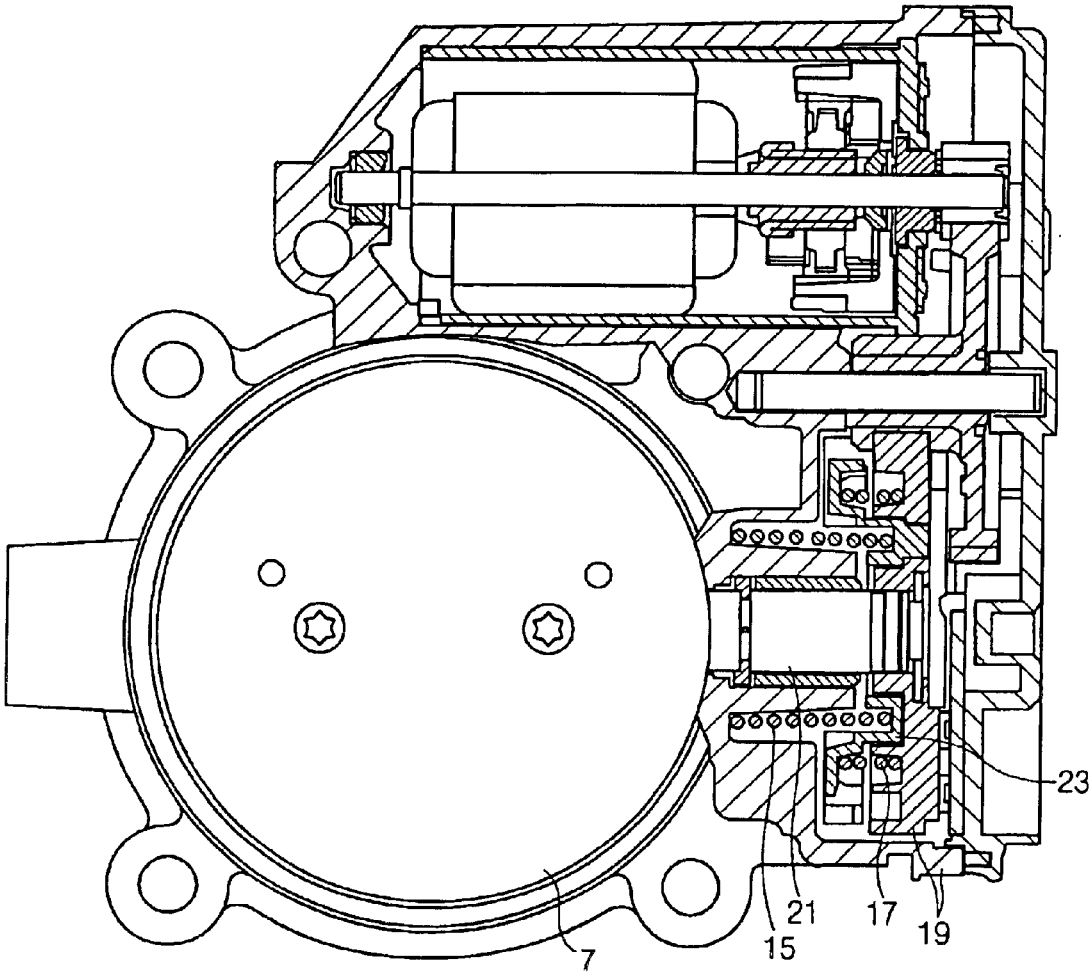
FIG. 3 is a partial sectional view of the electronic throttle control system of FIG. 1.
Figure 4:
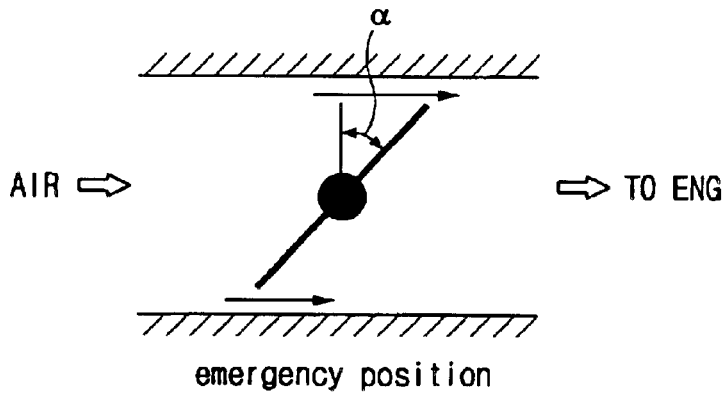
FIG. 4 shows a position of the throttle valve when the throttle actuator of FIG. 1 does not operate.
Figure 5:
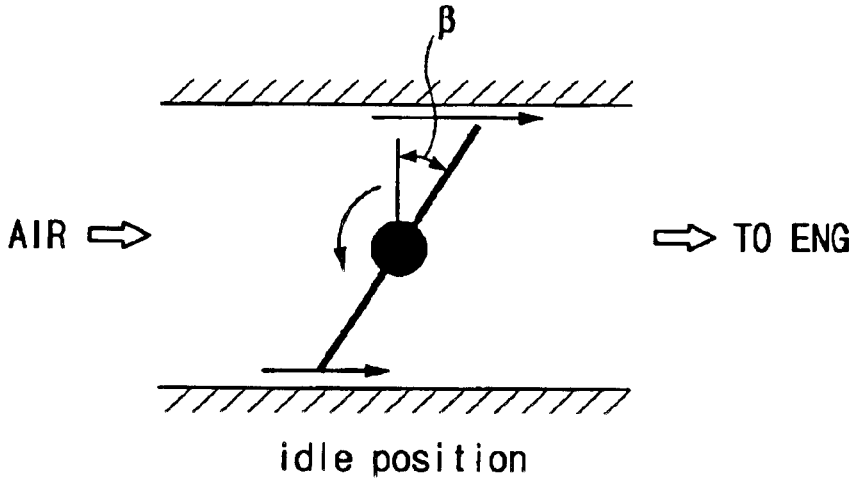
FIG. 5 shows a position of the throttle valve of FIG. 1 when the engine idles.

Referring to FIG. 3, the first return spring 15 is connected between an inner side (left side in FIG. 3) of the spring seat 23 and the throttle body 19, and the second return spring 17 is connected between an outer side (right side in FIG. 4) of the spring seat 23 and the throttle body 19. While the electronic throttle control system is not powered (that is, the throttle actuator 11 (FIG. 1) does not operate), the throttle valve 7 is positioned slightly open by the equilibrium of the rotating forces of the first return spring 15 and the second return spring 17. As shown in FIG. 4, it is preferable that the opening angle of the throttle valve 7 is a predetermined opening angle $\alpha$ when the throttle actuator 11 does not operate, or fails. To operate the engine at the predetermined speed while the throttle actuator is not powered, it is further preferable that the predetermined opening angle $\alpha$ is greater than a predetermined idle opening angle $\beta$, shown in FIG. 5, where the engine idles.

Figure 6:
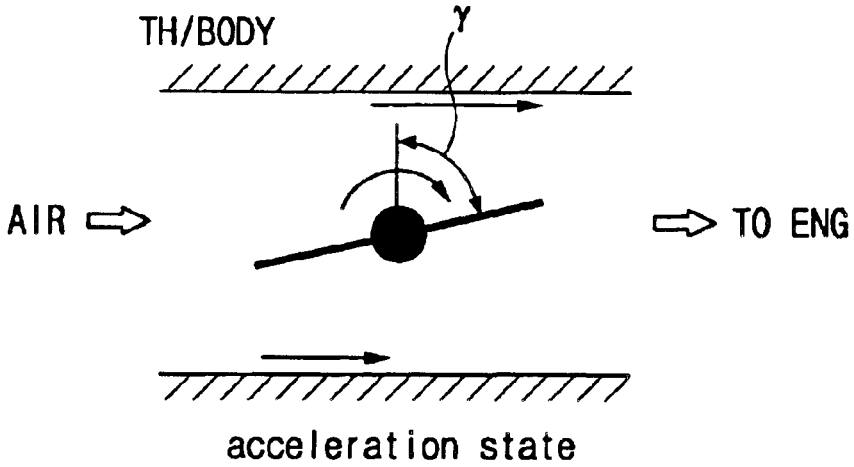
FIG. 6 shows a position of the throttle valve of FIG. 1 when a vehicle is accelerated.

In a high acceleration state, shown in FIG. 6, the throttle opening angle becomes greater than the idle opening angle. Thus, it is preferable that the predetermined opening angle $\alpha$ is set as a value at which the engine can be operated at the predetermined speed, enabling the vehicle to move.

Returning to FIG. 1, if a signal indicative of the position of the accelerator pedal 1 is input to the engine control unit 5, the engine control unit 5 determines a target throttle opening angle based in part on the accelerator pedal position, and outputs the corresponding signal. The throttle control unit 9 controls the throttle actuator 11 to actuate the throttle valve 7 such that the throttle valve 7 is positioned in the target position (for example, in an acceleration position, in a deceleration position, or in an idle position), based on the signal of the engine control unit 5. If the electronic throttle control system is not powered due to a failure of the electronic throttle control system, the throttle valve 7 is positioned to be slightly open (where the throttle valve angle is $\alpha$) by the resultant force of the rotating forces provided by the first return spring 15 and the second return spring 17.

Consequently, the bypass line that is needed to operate the engine in case of the failure of a conventional throttle control system may be removed. This decreases the manufacturing cost of the electronic throttle control system. Furthermore, the bypass valve that is disposed in a bypass line may also be removed so that the overall control of the electronic throttle control system becomes simpler and, therefor, the possibility of failure decreases.

Although preferred embodiments of the present invention have been described in detail hereinabove, it should be clearly understood that many variations and/or modifications of the basic inventive concepts herein taught which may appear to those skilled in the present art will still fall within the sprit and scope of the present invention, as defined in the appended claims.

Throughout this specification and the claims which follow, unless explicitly described to the contrary, the word "comprise" or variations such as "comprises" or "comprising" will be understood to imply the inclusion of stated elements but not the exclusion of any other elements.

What is claimed is:

1. An electronic throttle control system, comprising:

an engine control unit, said engine control unit determining a target throttle position based on engine operating parameters;

an accelerator pedal position sensor, said pedal position sensor sending a signal indicative of an accelerator pedal position to the engine control unit;

a throttle control unit, said throttle control unit operating a throttle actuator according to a target throttle position signal from the engine control unit;

a throttle valve positioned by the throttle actuator to the target throttle position;

a connecting shaft fixedly connected to the throttle valve;

a spring seat fixedly connected to the connecting shaft, wherein the spring seat has a circular plate shape;

a first return spring, connected between the spring seat and throttle body, acting on the throttle valve in a closing direction; and a second return spring, connected between the spring seat and the throttle body, acting on the throttle valve in an opening direction, the first return spring and second return spring being positioned and configured to position the throttle valve at an emergency position if the throttle control system fails;

wherein the first return spring and the second return spring are disposed on opposite sides of the spring seat.

2. The system of claim 1, further comprising a throttle position sensor, said throttle position sensor sending a throttle position signal to the electronic control unit and said engine control unit determining the target throttle position based on the throttle position signal.

3. An electronic throttle control system comprising:

an accelerator pedal position sensor for detecting a position of an accelerator pedal;

a throttle actuator for actuating a throttle valve to rotate;

a control unit for determining a target throttle position based on the accelerator pedal position, and for controlling the throttle actuator in accordance with the target throttle position; and a biasing mechanism providing rotational force to the throttle valve so that, if the throttle actuator is not powered, an opening angle of the throttle valve is greater than an idle opening angle, wherein the biasing mechanism comprises:

a connecting shaft fixedly connected to the throttle valve;

a spring seat fixedly connected to the connecting shaft, wherein the spring seat has a circular plate shape;

a first return spring connected between the spring seat and a throttle body such that the first return spring urges the throttle valve to rotate in a closing direction; and a second return spring connected between the spring seat and the throttle body such that the second return spring urges the throttle valve to rotate in an opening direction;

wherein the first return spring and the second return spring are disposed on opposite sides of the spring seat.

4. The system of claim 3, wherein the first return spring and the second return spring are coil springs.

5. A throttle control system, comprising:

a throttle valve at a throttle position;

a throttle valve actuator for positioning the throttle valve according to a target throttle position signal;

a control unit for determining a target throttle position and for controlling the throttle valve actuator to position the throttle valve at the target throttle position;

an accelerator pedal position sensor for detecting an accelerator pedal position and communicating the accelerator pedal position to the control unit, wherein the control unit determines the target throttle position based on the accelerator pedal position;

a throttle position sensor for determining the throttle position and communicating the throttle position to the control unit; and a biasing mechanism for positioning the throttle valve at an emergency position when the throttle control system fails, wherein the biasing mechanism comprises:

a connecting shaft fixedly connected to the throttle valve;

a spring seat fixedly connected to the connecting shaft, wherein the spring seat has a circular plate shape;

a first return spring connected between the spring seat and a throttle body such that the first return spring urges the throttle valve to rotate in a closing direction; and a second return spring connected between the spring seat and the throttle body such that the second return spring urges the throttle valve to rotate in an opening direction;

wherein the first return spring and the second return spring are disposed on opposite sides of the spring seat.

6. The system of claim 5, wherein the control unit comprises an engine control unit and a throttle control unit and the throttle control unit communicates with the throttle valve actuator.

* * * * *